United States Patent [19]

Planiol

[11] 4,138,067

[45] Feb. 6, 1979

[54] CENTRIFUGAL VACUUM IMPACT PULVERIZING MILLS

[76] Inventor: René Planiol, Varennes, 36700 Loches, France

[21] Appl. No.: 785,115

[22] Filed: Apr. 6, 1977

[30] Foreign Application Priority Data

Apr. 7, 1976 [FR] France ..... 76 10130

[51] Int. Cl.[2] ..... B02C 23/00

[52] U.S. Cl. ..... 241/275; 51/434; 241/DIG. 14

[58] Field of Search ..... 241/275, DIG. 10, DIG. 14; 51/434

[56] References Cited

U.S. PATENT DOCUMENTS

| | | | |
|---|---|---|---|
| 2,609,993 | 9/1952 | Planiol | 241/275 X |
| 3,544,015 | 12/1970 | Gulic et al. | 241/275 X |
| 3,716,947 | 2/1973 | Carpenter et al. | 241/275 UX |
| 3,782,643 | 1/1974 | Carpenter, Jr. | 241/275 X |
| 3,860,184 | 1/1975 | Acton | 241/275 |
| 3,995,784 | 12/1976 | Izquierdo | 241/275 |

*Primary Examiner*—Howard N. Goldberg
*Attorney, Agent, or Firm*—Jacobi, Lilling & Siegel

[57] ABSTRACT

A vacuum impact pulverizing mill comprising a housing, a cover sealingly closing said housing, a rotor inside said housing, motor means for driving said rotor, impact targets encompassing said rotor and fixed to said housing, conduit means for delivering granules to be comminuted to said rotor substantially along the axis thereof, means for maintaining the interior of said housing under vacuum, and means protecting the rotor against comminuted particles issuing from the targets.

7 Claims, 7 Drawing Figures

CENTRIFUGAL VACUUM IMPACT PULVERIZING MILLS

This invention has for its object improvements to centrifugal vacuum impact pulverizing mills.

A centrifugal vacuum impact pulverizing mill has already been proposed, for example in U.S. Pat. No. 2,609,993; it is a machine comprising a rotor which has radially extending vanes and which is placed in a housing where vacuum is maintained.

The material to be comminuted is introduced along the axis of the rotor and is projected by the latter in the form of jets which impact with targets spaced on the internal surface of the housing. The granules shattered by the impact onto the targets are transformed into a cloud of fine particles which fills the housing and which is collected at the lower end thereof where it falls by gravity. These vacuum pulverizing mills are of interest in many fields and specially in the field of cement manufacturing. Compared to typical ball mills they possess the advantage of producing a finer comminuted matter in which the dimension of the particles is more uniform. The energy consumption is at the same time, substantially decreased. Such vacuum mills present however the disadvantage of a relatively quick wear of the rotor owing to the abrasion of the comminuted particles. This deterioration weights heavily on the operation cost of the mill and on the stopping periods required for maintenance of the rotor.

A vacuum impact pulverizing mill according to this invention is characterized in that it comprises means to protect the rotor against the particles of comminuted material issued from the impacts targets.

In a first embodiment improvements result from the rotor structure itself which has to comprise a minimum number of vanes thus distributing the particle feed into a minimum number of dense projection jets.

In another embodiment, the protection means of the rotor are constituted by wear plates or shields placed inside the housing in such a way as to leave free passage to the jets of uncomminuted granules directed towards the targets and at the same time to oppose the return onto the rotor of the communuted particles issued from the targets. Otherwise comminuted particles may impact against the rotor after having been directed from the targets in directions other than that of incidence, or yet after having undergone one or many impacts on the walls of the housing of the mill.

The invention will be better understood by the following description given as example and with reference to the accompanying drawings wherein:

FIG. 1 is a schematic view of a known vacuum impact pulverizing mill; (U.S. Pat. No. 2,609,993)

Figure 1:
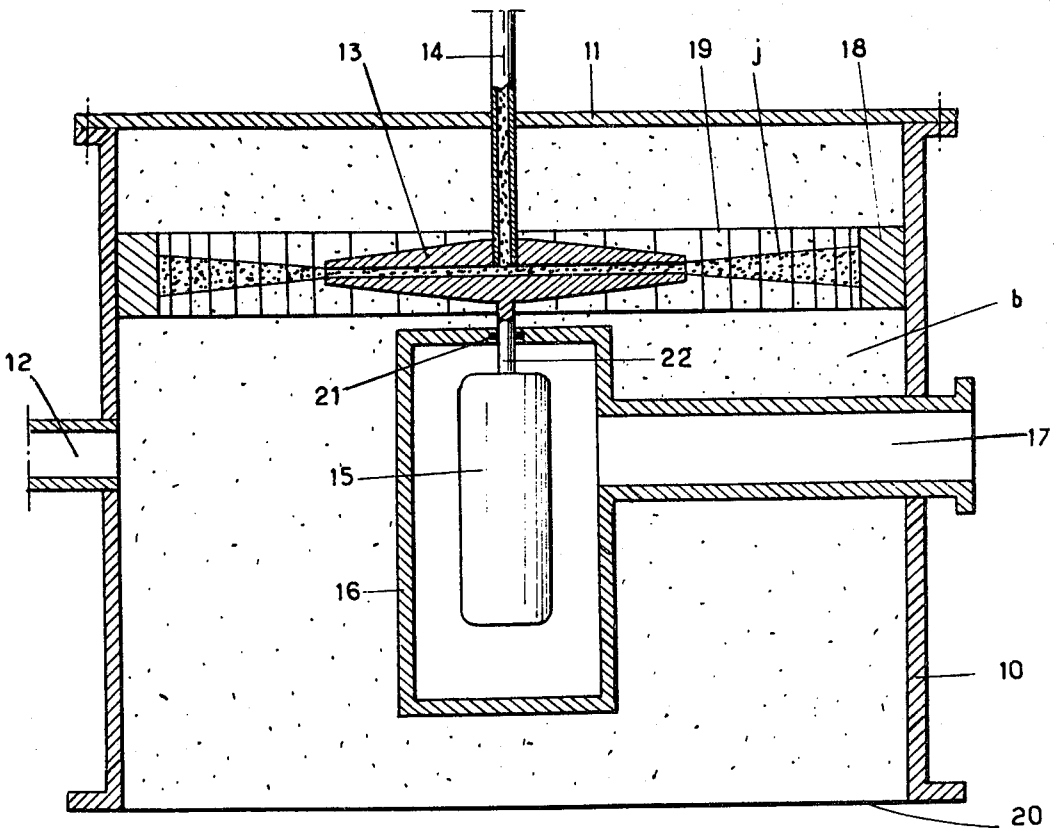
Fig.1 Prior Art

Reference is first made to FIG. 1 illustrating the operating principle of a vacuum impact pulverizing mill of the type described in U.S. Pat. No. 2,609,993. Such a mill comprises a housing 10 closed by a cover 11 and maintained under vacuum by means of a pump, not shown, connected to a pipe 12 fixed on the sidewall of the housing. Inside the housing is placed a rotor 13 somewhat similar to that of a centrifugal ventilator and which comprises radially extending vanes for distribution by rotation of the uncomminuted material into jets j. The uncomminuted material is introduced by an axial conduit 14 penetrating through the cover 11. The rotor is rotated by a motor 15 placed in a casing 16 connected to the atmosphere through a pipe 17 which penetrates through the housing 10.

Housing 10 carries an impact ring 18 the mean plane of which is substantially that of rotor 13 and in which are defined impact targets 19 onto which are shattered the granules of the material to be comminuted. The comminuted matter forms in housing 10 a cloud b of particles falling by gravity towards the lower part of the housing, from which they are extracted by means not shown. A tight seal 21 is provided at the passage of shaft 22 of motor 15 through casing 16.

In the absence of any particular precautions, the particles of the cloud b issued directly from the targets 10 as well as those which are directed towards the rotor after impact against the wall of the housing 10 or the cover 11, produce on the rotor and effect similar to that of an intense sand blasting producing a relatively quick wear of the rotor on account of its high rotation speed, whatever the speed of said particles.

To obviate this drawback, the invention provides means to protect the rotor against the comminuted particles issued directly or indirectly from the targets 19.

In a first embodiment the rotor 13 is constituted in such a way that the number of jets j of granules to be comminuted is greater than a predetermined value which is a function of the structure of the mill. The comminuted particles issued from the targets 19 are stopped by said jets, in such a way that the rotor is protected against them.

If R is the minimal distance between the targets 19 and the center of the rotor, and if r is the radius of the rotor, it has been found that the optimum result is obtained when the number N of vanes of the rotor is equal to or greater than:

$$8r/R-r$$

Although the wear out of a rotor of a mill is reduced when the above relation is satisfied the rotor still remains subjected to the abrasive action of the comminuted particles which collide with it after having issued from the targets 19 and having been reflected back by the wall of the housing 10 or the cover 11. Thus the invention provides complementary means of protection of the rotor which will be new described with reference to FIGS. 2 to 5.

Figure 2:
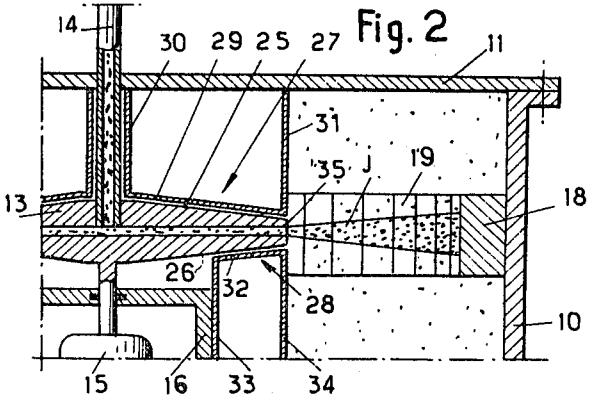
FIG. 2 is a partial view similar to that of FIG. 1 with a first embodiment of a mill improved according to this invention.

In a first embodiment, FIG. 2, wear means or shields 27 and 28 of annular shape are placed on both sides of the upper side 25 and of the lower side 26 of rotor 13 and they are fixed respectively to the cover 11 and to the casing 16. The wear means 27 comprise a surface 29 parallel to and at close distance from the surface 25 of the rotor. The two cylindrical surfaces 30 and 31 are coaxial with conduit 14, the radius of the first of said surface being slightly greater than that of the conduit, and the radius of the second of said surfaces being practically equal to that of the rotor. Similarly, the wear means 29 comprise a surface 32 parallel and at a close distance from the lower surface 26 of the rotor. The cylindrical surface 33 serves to secure it onto the casing 16, and the cylindrical surface 34 is, as surface 31, of a radius substantially equal to that of the rotor. In such an embodiment, the abrasive action of the cloud b on faces 25 and 26 of the rotor is practically eliminated and only the peripheral section 35 of the rotor might be damaged.

Figure 3:
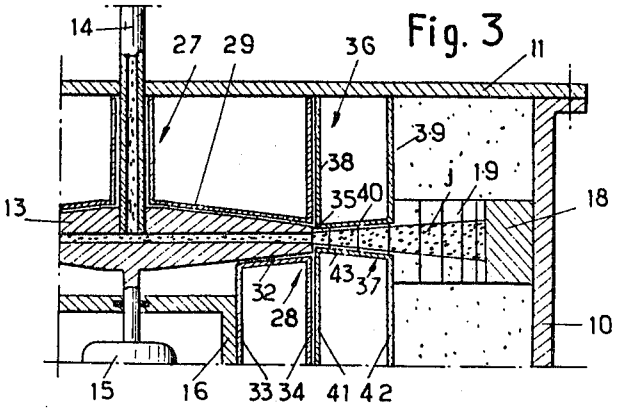
FIG. 3 is a view similar to that of FIG. 2 but comprising another embodiment.

To prevent this damaging effect, another embodiment, FIG. 3, suggests to add to the wear means 27 and 28 complementary elements 36 and 37 integral with the means 27 and 28 or designed to be fixed on these. Element 36 is constituted by cylindrical walls 38 and 39 connected by a bottom portion 40 shaped to match substantially the boundary surface of jets j. Element 37 is constituted by cylindrical walls 41 and 42 connected by a portion 43 shaped to substantially match the boundary surface of jets j. The elements 36 and 37 are built into the apparatus in such a way that their walls 40 and 43 respectively limit an annular space slightly diverging in the direction going from the rotor 13 towards the targets 19, said space giving passage to the jets j and preventing at the same time practically any collision of the comminuted particles with the peripheral section 35 of the rotor near which are placed the cylindrical walls 38 and 41.

Figure 4:
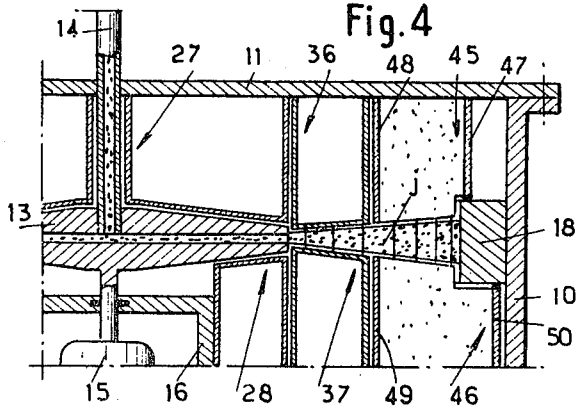
FIG. 4 is a view similar to that of FIG. 3 but with yet another embodiment.
Figure 6:
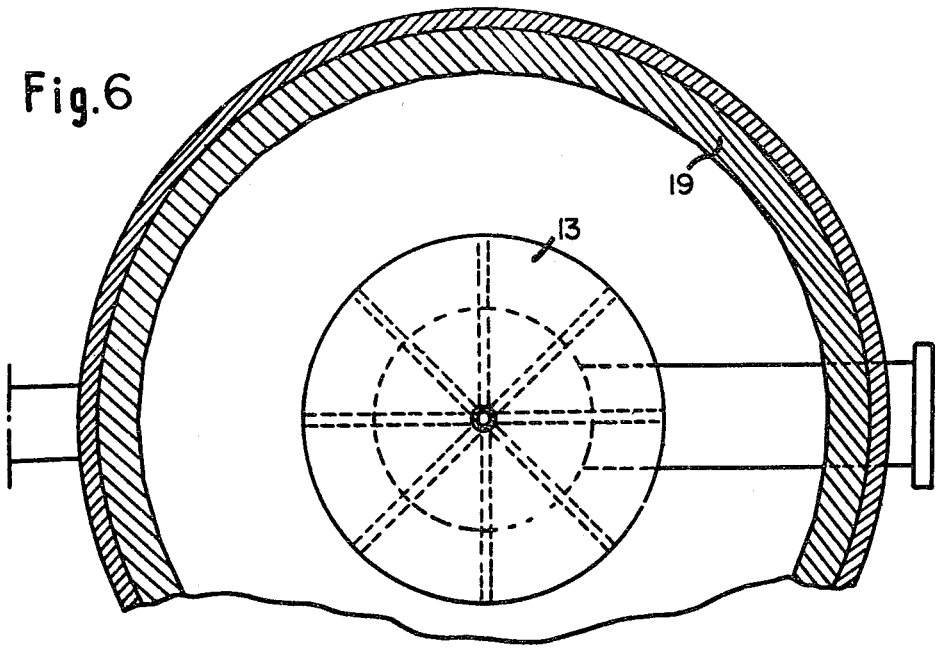
FIG. 6 is a top plan view, partly in section, of a mill according to the present invention.
Figure 7:
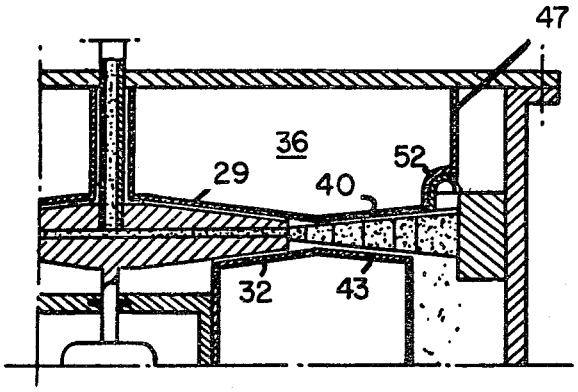
FIG. 7 is a view similar to FIGS. 2 to 5 of a further embodiment of the present invention.

In the embodiment shown in FIG. 4, the apparatus further comprises two protective means 45 and 46 placed respectively above and underneath the path of the jets j and secured, for the first one, either to the cover 11 and/or to the element 36 and, for the second one, either to the housing 10 and/or the element 37. Each of the protective means 45, 46 is made of two cylindrical tubes shown at 47, 48 for member 45 and at 49, 50 for member 46 connected by helicoidal type surfaces of opposite inclinations. Thus are eliminated turbulent phenomena in the dust cloud b and the discharge of the comminuted matter is enhanced towards the outlet 20 of the housing.

Figure 5:
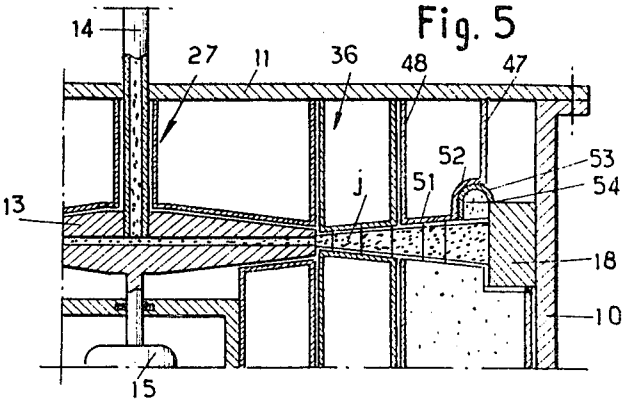
FIG. 5 is a view similar to FIGS. 2 to 4 but with still another embodiment.

In a modification, FIG. 5, member 46 is preserved but member 45 is modified; it comprises between the lower edges of the cylinders 47 and 48, in the vicinity of the path of the jets j, a full wall 51, with a direction extending that of the wall 40, on parts of its length. The wall 51 is connected to the cylindrical wall, 47 and thus in the vicinity of the targets 19 by a curved section 52 with its concavity turned towards the targets.

Such section 52 forming a gutter 53 bearing on the targets by its edge 54 opposite to wall 51 and is preferably lined with a very hard material.

Such a configuration enables, not only to reduce the volume of the cloud b of comminuted particles inside the apparatus but it also directs downwards those among the comminuted particles issued from the targets and which had initially a speed component towards the cover.

The protection means of the rotor and those which enhance the collection of the comminuted particles at the lower end of the mill can be realized in two solid parts. In this case one of the parts comprising surface 29, surface 40, cylindrical wall 47 and wall 51–52 is placed at the upper part of the jets of granules to be comminuted and the other part comprising surfaces 32, 43 and member 46 is placed underneath said jets. Further modifications and changes can be made to the above described embodiments without departing from the invention.

Also, for example, the motor driving the rotor can be immersed in an oil container connected to suction means instead of being in a casing connected to the atmosphere.

Similarly, the inner surfaces of the housing and of the cover can be lined with a layer, say of aluminum oxide deposited by flame or plasma spraying; this would avoid severe abrasion and any alteration of color of the comminuted material as required, for instance, in the manufacture of special cements.

What is claimed is:

1. A vacuum impact pulverizing mill comprising a housing, a cover sealingly closing said housing, a rotor inside said housing, said rotor having upper and lower portions, motor means for driving said rotor, impact targets encompassing said rotor and fixed to said housing, conduit means for delivering granules to be comminuted to said rotor, substantially along the axis thereof, means for maintaining the interior of said housing under vacuum, and means substantially surrounding the upper and lower portions of the rotor for shielding the rotor against comminuted particles issuing from the targets.

2. A pulverizing mill according to claim 1, wherein said rotor comprises vanes defining projection channels for the formation of jets of granules to be comminuted on the targets, the number of said channels being equal to or greater than 8r/R-r, where r designates the radius of the rotor and R is the minimal distance from the targets to the center of said rotor.

3. A pulverizing mill according to claim 1, wherein said shielding means comprise two shields each having a cylindrical wall of radius practically equal to the radius of the rotor and a wall extending parallel to and at a small distance from the upper side of the rotor, for one of the shields, and parallel to and at a small distance from the lower side of the rotor for the other shield.

4. A pulverizing mill according to claim 3, further comprising two elements coaxial with the rotor, one element having a first annular wall extending from the vicinity of the periphery of the rotor parallel to and at a small distance from the upper boundary surface of the jets of granules to be comminuted, and the other element having an annular wall extending from the vicinity of the periphery of the rotor parallel to and at a small distance from the lower boundary surface of said jets.

5. A pulverizing mill according to claim 4, further comprising members for collecting and guiding towards the lower end of the housing the comminuted particles issued from the targets.

6. A pulverizing mill according to claim 5, wherein the element disposed above the jets further comprises an annular surface which is parallel to and near a portion of the boundary surface of the jets, said first wall terminating in the vicinity of the targets by a curved portion having its concavity turned towards the targets, and said curved portion being lined with a layer of very hard material designed to deviate towards the lower end of the housing the particles issued from the targets and which have an upward speed component.

7. A pulverizing mill according to claim 5, wherein said shields and said elements located above the jets are made of one solid piece, and wherein said shields and said elements located underneath the jets are also made of one solid piece.

* * * * *